US009550285B2

(12) United States Patent
Lai

(10) Patent No.: US 9,550,285 B2
(45) Date of Patent: Jan. 24, 2017

(54) CONNECTION DEVICE FOR CONNECTING BIT TO HAND TOOL

(71) Applicant: Jin-Tsai Lai, Taichung (TW)

(72) Inventor: Jin-Tsai Lai, Taichung (TW)

( * ) Notice: Subject to any disclaimer, the term of this patent is extended or adjusted under 35 U.S.C. 154(b) by 248 days.

(21) Appl. No.: 14/325,389

(22) Filed: Jul. 8, 2014

(65) Prior Publication Data

US 2016/0008963 A1 Jan. 14, 2016

(51) Int. Cl.
*B25B 23/00* (2006.01)

(52) U.S. Cl.
CPC ..... *B25B 23/0035* (2013.01)

(58) Field of Classification Search
CPC ... B25B 15/02; B25B 23/0035; B25B 23/0042
USPC ..... 81/177.1, 177.85
See application file for complete search history.

(56) References Cited

U.S. PATENT DOCUMENTS 7,467,575 B2 * 12/2008 Lai ..... B25B 15/02 81/177.1
7,717,016 B2 * 5/2010 Lai ..... B25B 23/0042 81/177.1
7,762,161 B2 * 7/2010 Lai ..... B25B 15/04 81/58.3
9,108,304 B2 * 8/2015 Lai ..... B25B 13/463

* cited by examiner

*Primary Examiner* — Hadi Shakeri
(74) *Attorney, Agent, or Firm* — Che-Yang Chen; Law Offices of Scott Warmuth

(57) ABSTRACT

A hand tool includes a handle with a shank and a fixing member is connected to the shank. An isolation layer is coated on the outside of the shank and an annular groove is defined between the isolation layer and the fixing member. A socket has a lip having a positioning member to be engaged with a notch of the fixing member. A guide member is located beside the positioning member. A ring-shaped locking member is connected to the socket and has a recess with which the guide member is engaged. The locking member has two flexible blocks. A positioning member has a protrusion inserted into the through hole of the locking member and has a ridge contacting the lip of the socket. The protrusion has two passages, which are engaged with the two blocks. A bit is inserted into the reception hole of the positioning member.

3 Claims, 7 Drawing Sheets

CONNECTION DEVICE FOR CONNECTING BIT TO HAND TOOL

BACKGROUND OF THE INVENTION

1. Fields of the Invention

The present invention relates to a hand tool, and more particularly, to a hand tool with a connection device at the distal end of the shank so as to quickly connect a bit to the connection device, or release a bit from the connection device.

2. Descriptions of Related Art

The conventional screwdriver has a handle and a shank integrally extending from the handle, the shank has a function end such as the keystone tip, cabinet tip or Phillips head. However, each conventional screwdriver can only drives a specific type of the screw head. Therefore, the user has to carry multiple screwdrivers with him/her.

U.S. Pat. No. 7,467,575 B2 discloses a hand tool that has a handle, a fixing member, an adjustment member and a bit, wherein a reception hole is defined axially in the handle and the fixing member is fixed to one end of the reception hole to restrict the adjustment member. The fixing member has a positioning hole in which the bit is inserted. The fixing member has at least one slot communicating with the positioning hole. The adjustment member has a block which is inserted into the positioning hole via the at least one slot to position the bit. By operating the adjustment member, the block is removed from the positioning hole to release the bit. However, the connection device is located at one end of the handle and the bit is connected to the connection device, the length of the bit is limited so that the bit cannot reach the object at a deep hole.

The present invention intends to provide a connection device at the distal end of the shank so as to quickly connect a bit to the connection device, or release a bit from the connection device.

SUMMARY OF THE INVENTION

The present invention relates to a hand tool and comprises a shank and a handle is connected to a first end of the shank. A fixing member is connected to a second end of the shank. An isolation layer is coated on the outside of the shank, and an annular groove is defined between the isolation layer and the fixing member. A polygonal room is defined in the distal end of the fixing member and an insertion hole is defined in the inner end of the polygonal room. At least one notch is defined in the wall at the distal end of the fixing member. A socket is connected to the fixing member and has a lip formed on one end thereof. At least one positioning member extends from the lip and is located in the at least one notch of the fixing member. A guide member is located beside the at least one positioning member.

A locking member is connected to the socket and has a through hole. At least one recess is defined in the inner periphery of the through hole. The guide member of the socket is engaged with the at least one recess of the locking member. Two flexible blocks extend from the inner periphery of the through hole of the locking member.

A positioning member connected to one side of the locking member and has a protrusion extending therefrom. The protrusion is inserted into the through hole of the locking member and has a space defined therein. A ridge extends from the outside of the protrusion and contacts the lip of the socket. The protrusion has two first passages and two second passages. The two blocks are engaged with the two second passages. The positioning member has a polygonal reception hole which communicates with the space.

A bit has an insertion end and a function end. The insertion end is inserted into the reception hole and has a locking groove. The blocks are engaged with the locking groove.

Preferably, multiple engaging slots are defined in the inner periphery of the isolation layer in the annular groove. The socket has multiple flanges which are engaged with the engaging slots.

Preferably, another isolation layer is formed on the outside of the bit except for the function end.

The primary object of the present invention is to provide a hand tool wherein the bit can be quickly connected to the shank of the hand tool or released from the shank of the hand tool so that the bit is able to reach the object at a deep hole.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
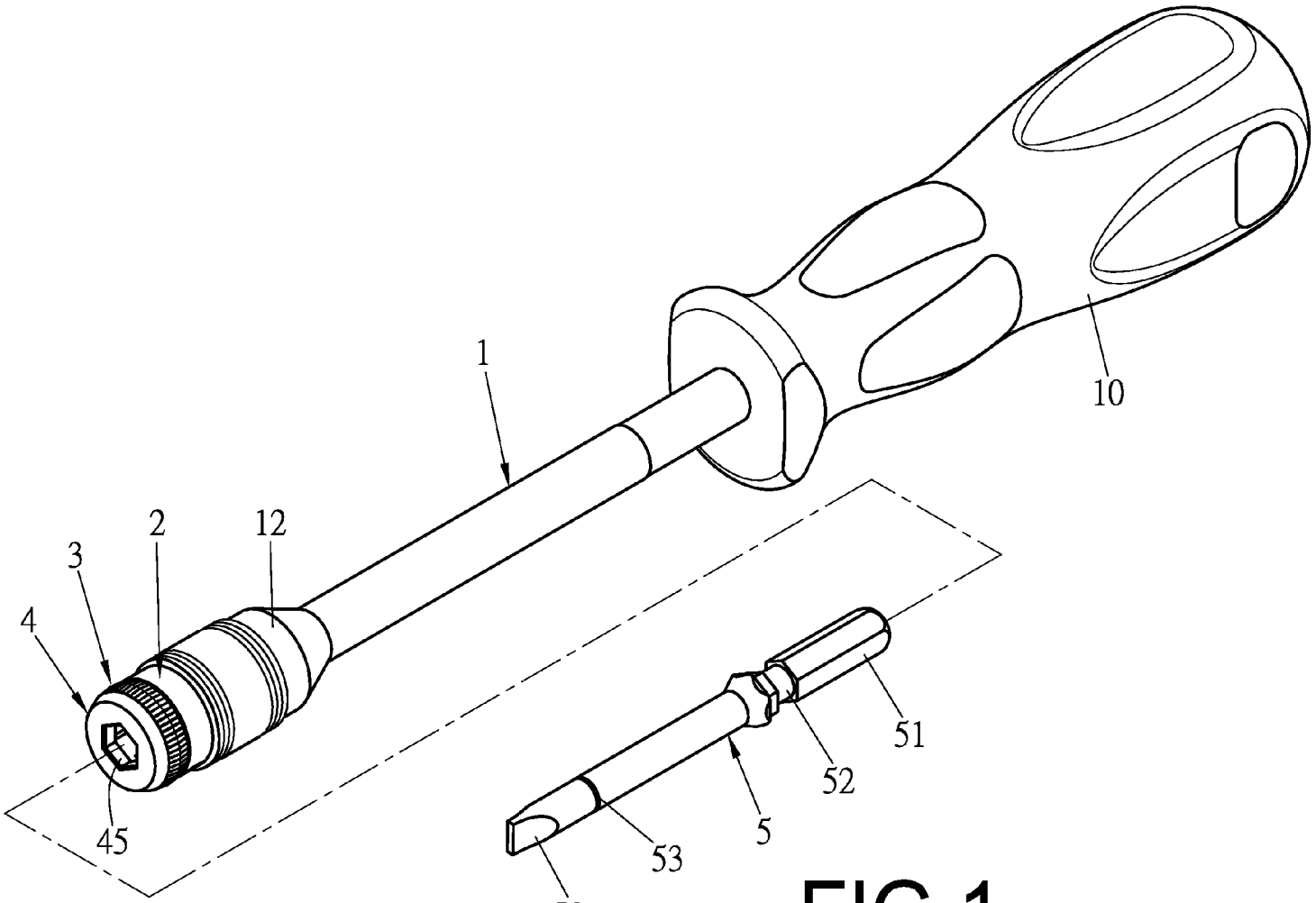
FIG. 1 is an exploded view of the hand tool of the present invention and a bit.
Figure 2:
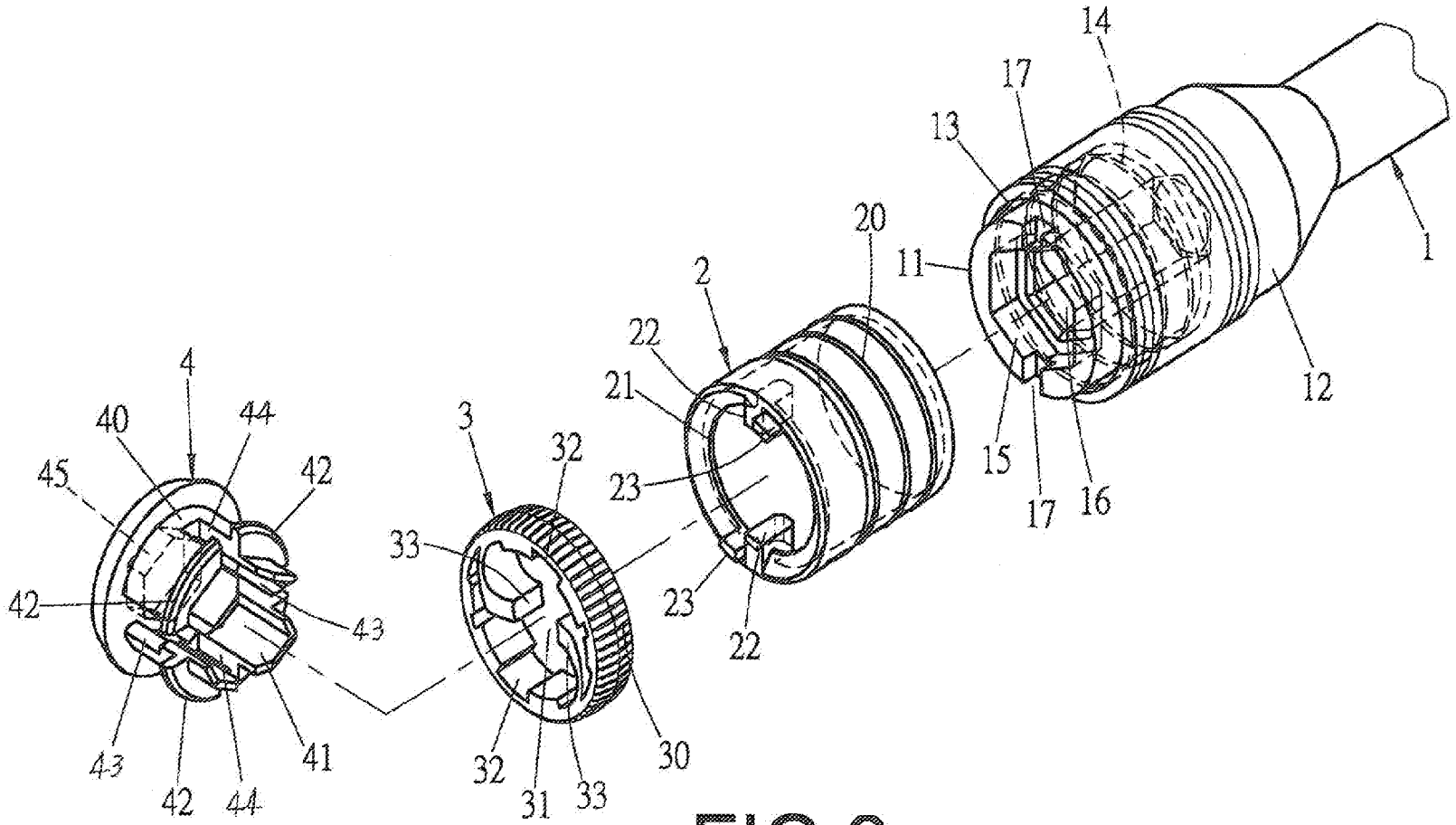
FIG. 2 is an exploded view of the hand tool and the socket of the present invention and a bit.
Figure 3:
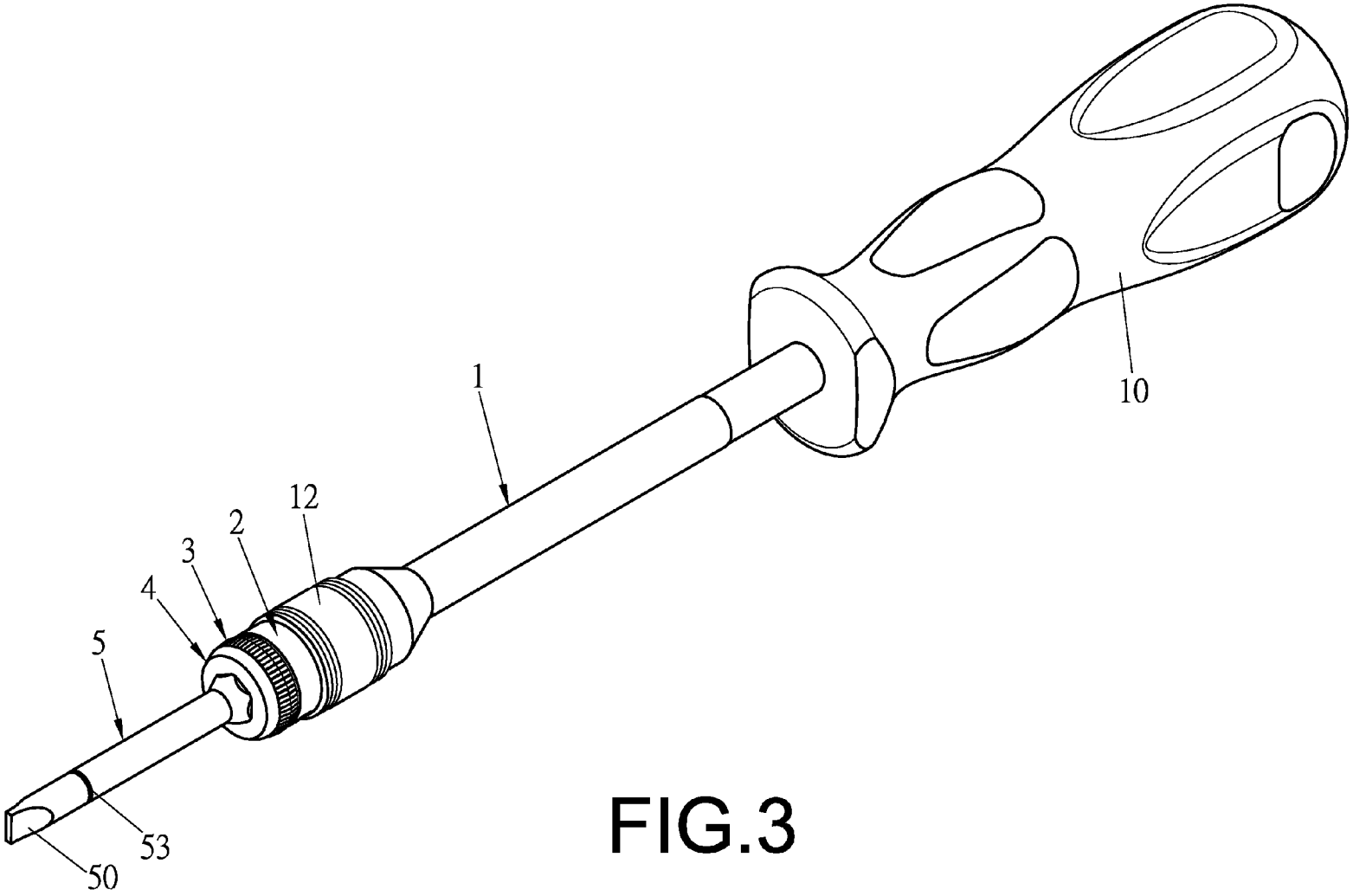
FIG. 3 is a perspective view of the hand tool of the present invention to which a bit is connected.

Referring to FIGS. 1 to 6, the hand tool of the present invention comprises a shank 1 and a handle 10 is connected to a first end of the shank 1. A fixing member 11 is connected to a second end of the shank 1. An isolation layer 12 is coated on the outside of the shank 1, and an annular groove 13 is defined between the isolation layer 12 and the fixing member 11. Multiple engaging slots 14 are defined in the inner periphery of the isolation layer 12 in the annular groove 13. A polygonal room 15 is defined in the distal end of the fixing member 11 and an insertion hole 16 is defined in the inner end of the polygonal room 15. Two notches 17 are defined in the wall at the distal end of the fixing member 11. A socket 2 is connected to the fixing member 11 and has multiple flanges 20 on the outside thereof. The multiple flanges 20 are engaged with the engaging slots 14 of the shank 1. A lip 21 is formed on one end thereof and has an inclined face. Two positioning members 22 extend from the lip 21 and are located in the notches 17 of the fixing member 11. A guide member 23 is located beside each of the two positioning members 22.

A locking member 3 is connected to the socket 2 and has a through hole 31. The outside of the locking member 3 is a knurled surface 30 which provide good grip. Two recesses 32 are defined in the inner periphery of the through hole 31. The guide members 23 of the socket 2 are engaged with the two recesses 32 of the locking member 3. Two flexible blocks 33 extend from the inner periphery of the through hole 31 of the locking member 3.

A positioning member 4 is connected to one side of the locking member 3 and has a protrusion 40 extending therefrom. The protrusion 40 is inserted into the through hole 31 of the locking member 3 and has a space 41 defined therein. A ridge 42 extends from the outside of the protrusion 40 and contacts the lip 21 of the socket 2. The protrusion 40 has two first passages 43 and two second passages 44. The two blocks 33 are engaged with the two second passages 44. The positioning member 4 has a polygonal reception hole 45 which communicates with the space 41.

A bit 5 has an insertion end 51 and a function end 50, wherein the insertion end 51 is inserted into the reception hole 45 and has a locking groove 52. The blocks 33 are engaged with the locking groove 52. Another isolation layer 53 is formed on the outside of the bit 5 except for the function end 50.

Figure 4:
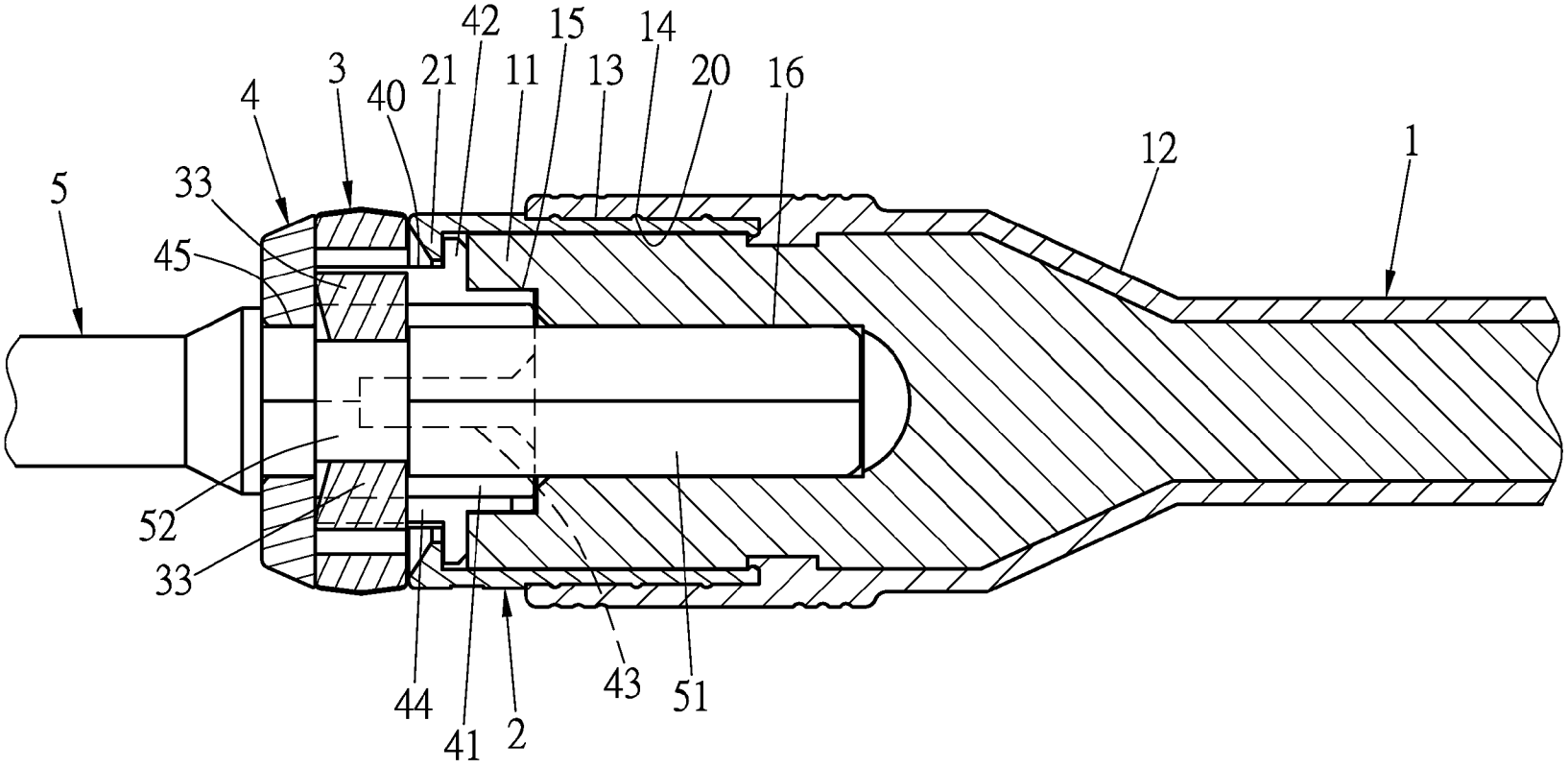
FIG. 4 is a cross sectional view to show that a bit is the hand tool of the present invention.
Figure 5:
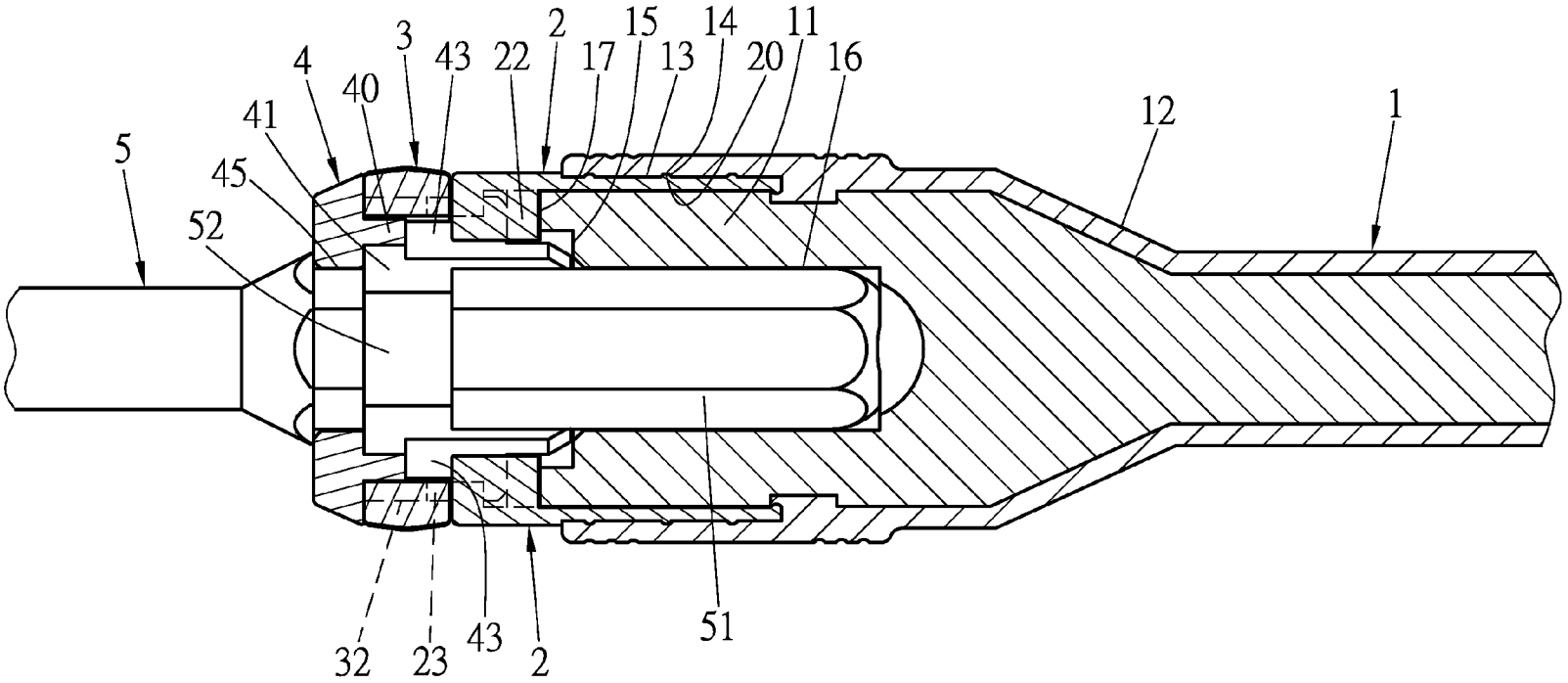
FIG. 5 is another cross sectional view to show that a bit is the hand tool of the present invention.
Figure 6:
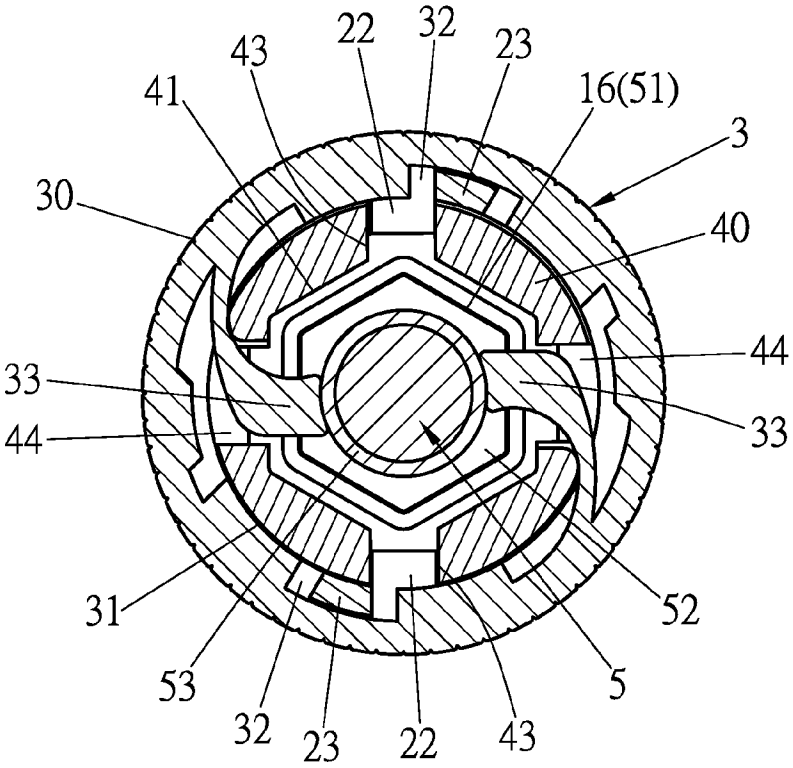
FIG. 6 is an end cross sectional view to show that the locking member of the hand tool of the present invention is in locked status.

The socket 2 is inserted into the annular groove 13 and the flanges 20 are engaged with the engaging slots 14. The positioning members 22 of the socket 2 are engaged with the notches 17 of the fixing member 11. The locking member 3 is connected to the protrusion 40 of the positioning member 4, and the two blocks 33 of the locking member 3 are engaged with the second passages 44 of the positioning member 4 respectively so as to be positioned in the space 41 of the positioning member 4. The positioning member 4 and the locking member 3 are connected to the socket 2 to insert the protrusion 40 of the positioning member 4 in the socket 2 and the polygonal room 15 of the positioning member 11. The guide members 23 on the socket 2 are engaged with the recesses 32 of the locking member 3 as shown in FIGS. 5 and 6. The ridge 42 of the positioning member 4 is in contact with the lip 21 of the socket 2 as shown in FIG. 4. Therefore, the positioning member 4, the locking member 3 and the socket 2 are connected to the fixing member 11 on the shank 1. The insertion end 51 of the bit 5 is then inserted into the reception hole 45 and reaches the insertion hole 16 of the positioning member 11. The two blocks 33 of the locking member 3 are engaged with the locking groove 53 as shown in FIGS. 4, 6 to lock the bit 5 to the shank 1.

Figure 7:
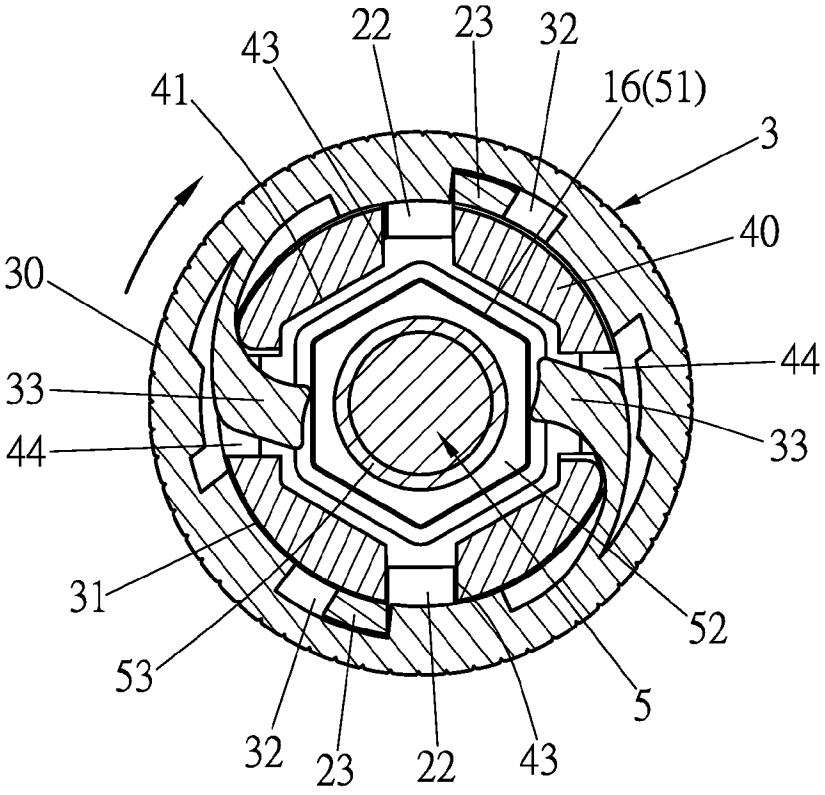
FIG. 7 is an end cross sectional view to show that the locking member of the hand tool of the present invention is in unlocked status.

When in use, as shown in FIGS. 6 and 7, the bit 5 is securely connected to the shank 1 by the engagement between the blocks 33 and the locking groove 53, so that the user can rotate the handle 10 to drive the bit 5 to tighten or loosen an object. When the bit 50 is to be replaced, the user simply rotates the locking ring 3 as shown in FIG. 7 to push the blocks 33 of the locking member 3 by the walls of the second passages 44, the two blocks 33 are flexibly moved outward and removed from the locking groove 52 of the bit 5. The bit 5 can be separated from the shank 1 and another bit 5 can be inserted into the reception hole 45 of the positioning member 4. The locking ring 3 is then released, the blocks 33 are again engaged with the locking groove 52 of the bit 5 to securely position the bit 5 to the shank 1. By the shank 1, the bit 5 can reach the object at a deep hole. The replacement of the bit 5 is easy and convenient.

While we have shown and described the embodiment in accordance with the present invention, it should be clear to those skilled in the art that further embodiments may be made without departing from the scope of the present invention.

What is claimed is:

1. A hand tool comprising: a shank and a handle connected to a first end of the shank, a fixing member connected to a second end of the shank, an isolation layer coated on an outside of the shank, an annular groove defined between the isolation layer and the fixing member, a polygonal room defined in a distal end of the fixing member and an insertion hole defined in an inner end of the polygonal room, at least one notch defined in a wall at the distal end of the fixing member; a socket connected to the fixing member and having a lip formed on an end thereof, at least one positioning member extending from the lip and located in the at least one notch of the fixing member, a guide member located beside the at least one positioning member; a locking member connected to the socket and having a through hole, at least one recess defined in an inner periphery of the through hole, the guide member of the socket engaged with the at least one recess of the locking member, two flexible blocks extending from the inner periphery of the through hole of the locking member; a positioning member connected to one side of the locking member and having a protrusion extending therefrom, the protrusion inserted into the through hole of the locking member and having a space defined therein, a ridge extending from an outside of the protrusion and contacting the lip of the socket, the protrusion having two first passages and two second passages, the two blocks engaged with the two second passages, the positioning member having a polygonal reception hole which communicates with the space, and a bit having an insertion end and a function end, the insertion end inserted into the reception hole and having a locking groove, the blocks engaged with the locking groove.

2. The hand tool as claimed in claim 1, wherein multiple engaging slots are defined in an inner periphery of the isolation layer in the annular groove, the socket has multiple flanges which are engaged with the engaging slots.

3. The hand tool as claimed in claim 1, wherein another isolation layer is formed on an outside of the bit except for the function end.

* * * * *